United States Patent [19]

Wrobbel

[11] 4,324,159

[45] Apr. 13, 1982

[54] OPEN END RATCHET WRENCH

[76] Inventor: Edward J. Wrobbel, 49 Williamsburg Dr., Fairport, N.Y. 14450

[21] Appl. No.: 161,842

[22] Filed: Jun. 23, 1980

[51] Int. Cl.[3] ..... B25B 13/28

[52] U.S. Cl. ..... 81/111

[58] Field of Search ..... 81/94, 98, 109, 111, 81/179, 180 C

[56] References Cited

U.S. PATENT DOCUMENTS

| | | | |
|---|---|---|---|
| 1,050,215 | 1/1913 | Hesse | 81/111 |
| 2,277,400 | 3/1942 | Hewitt et al. | 81/111 |
| 2,721,493 | 10/1955 | Bergland | 81/179 |

FOREIGN PATENT DOCUMENTS

| | | | |
|---|---|---|---|
| 1330300 | 5/1963 | France | 81/111 |

*Primary Examiner*—James G. Smith

*Attorney, Agent, or Firm*—Martin Lukacher

[57] ABSTRACT

A wrench has a pair of jaws which oppose each other to define the wrench opening. One of these jaws is pivotally mounted on the wrench body while the other may be fixed and integral with the wrench body. The pivotal jaw pivots in opposite directions so as to close the wrench opening and engage and drive a nut or bolt head when turned one way and to open the wrench opening and turn freely about the nut or bolt when turned the opposite way. The pivot about which the pivotal jaw rotates is on the same side of the wrench opening as the pivotal jaw itself such that the sum of the moments of the forces on the pivotal jaw close the jaw and align it with the nut or bolt head automatically at the start of the forward or driving stroke without any lost rotational motion or the need for springs or special cam surfaces.

27 Claims, 16 Drawing Figures

$a_{max} = .144\,a$ $b_{max} = \sqrt{F^2 - E^2}$ for any chosen D $F \leq WO + D$ $E = A + D$ $$d \doteq \frac{3}{16} P$$

$$d_{max} = \sqrt{F^2 - E^2}$$

$$F \leq WO + D$$

$$E = A + D$$

OPEN END RATCHET WRENCH

DESCRIPTION

The present invention relates to wrenches and particularly to an open end ratchet or one way wrench which opens, releases and closes on a return stroke and also closes to engage the item to be turned on the forward or driving stroke if not perfectly aligned.

The invention is especially suitable for use in torquing or driving hexagonal or square nuts or bolt heads. The invention may be used for driving any other item which may be engaged by an open end type of wrench. By the term 'item' is meant nuts or bolt heads or other hardware devices which may be turned, either tightened or loosened, by an open end wrench.

Various types of swinging jaw wrenches have been proposed. For the most part such wrenches are designed as pipe wrenches utilizing serrated teeth which are pulled into engagement with the pipe when the wrench is turned one way. Such wrenches do not have ratcheting action and must be removed from the pipe and reset each time the pipe is to be turned (see Obils, U.S. Pat. No. 1,496,944). In order to provide ratcheting action and to prevent the swinging jaw from releasing completely from the pipe, special springs are used (see Forsdahl, U.S. Pat. No. 1,635,930). Other swinging jaw wrenches must hook over the nut or bolt head, in order to retain the nut or bolt. The hook and other cooperating camming surfaces in the jaws set the nut or bolt into position after the return or ratchet stroke. There is, therefore, much lost motion in the torquing direction used for clamping the nut or bolt between the jaws, rather than for driving the nut or bolt. Such swinging jaw wrenches are not analogous to open end wrenches, since the hooked portion must be placed over and around the bolt rather than inserted into one end of the wrench as is the case with an open end wrench (see Matthews, U.S. Pat. No. 1,466,136).

In such swinging jaw wrenches as have been proposed, the forces on the swinging jaw tend to throw the swinging jaw away from the nut or bolt head, both during the return stroke as well as during the forward or torquing stroke. Springs are used to restore the swinging jaw to a position where it can engage the nut or bolt head (see Johnson, U.S. Pat. No. 1,281,020 or Mead, U.S. Pat. Nos. 1,735,257 and 2,194,049 and Simon, et al, U.S. Pat. No. 2,655,064). In the absence of a spring, resort must be had to a camming mechanism (see the above reference Matthews Patent).

It is an object of the present invention to provide an improved ratchet or one way wrench configured as an open end wrench which may be used with the same facility as a conventional open end wrench and yet provide ratchet action.

It is a further object of the present invention to provide an improved open end ratchet wrench with a pivoting jaw which eliminates lost rotational motion between return and forward driving or torquing strokes, i.e., the wrench immediately realigns itself with the item being driven at the beginning of turning on the forward stroke.

It is a still further object of the invention to provide an improved open end ratchet wrench having opposed jaws one of which pivots while the other is fixed with respect to the pivoting jaw which is arranged to develop forces on the pivoting jaw throughout the entire driving stroke to rotate the pivoting jaw against the item to clamp the item against the fixed jaw, or maintain a specified/predetermined wrench opening.

It is a still further object of the invention to provide an improved open end ratchet wrench having a pivoting jaw which does not require springs to hold the pivoting jaw against the item to be turned.

It is a still further object of the present invention to provide an improved open end ratchet wrench which does not require special cam surfaces to close and hold the pivoting jaw against the item being turned and, therefore, need not differ from the conventional configuration of an open end wrench.

It is a still further object of the present invention to provide an improved open end ratcheting wrench which does not require the nut or bolt to be tight to prevent turning thereof during the return stroke.

It is a still further object of the present invention to provide an improved one way wrench having a pivoting jaw mounted on a handle or body which can be designed to transfer driving torque to the handle or wrench body directly or through the pin upon which the jaw pivots, as desired.

It is a still further object of the present invention to provide an improved one way wrench which may be made in various wrench sizes to turn different sized items or adjustable as by making either the nonpivoting or pivoting jaw assembly movable to widen or narrow the wrench opening.

It is a still further object of the invention to provide an improved open end ratcheting wrench in which rounding the points on the nut or bolt being torqued (turned) is minimized, and is less likely to occur than in a conventional open end wrench.

It is a still further object of the present invention to provide an improved one way wrench wherein one wrench jaw pivots with respect to the other (the relatively fixed jaw), and which does not require weakening the fixed jaw as by adding clearances thereto in order to provide one way or ratcheting action.

Briefly described, a one way or ratchet open end wrench in accordance with the invention, has first and second jaws with opposing faces spaced from each other. The jaws define the wrench opening between their faces. The item to be turned is received within the wrench opening. The first jaw is rotatable about a pivot with respect to the second jaw in opposite directions. When the wrench is turned one way, the opening is closed or maintained closed and the jaws engage and drive the item. When the wrench is turned the opposite way, the opening enlarges and the wrench turns freely about the item and then closes when in position. In order to provide for the absence of lost rotational motion and to realign the wrench on the item at the beginning of the one way turn forward stroke (the torquing direction), the pivot is located so that the sum of the moments of the forces on the pivoting jaw about the pivot, when the wrench is turned in the torquing direction, is in the direction to rotate the pivoting jaw to close the wrench opening or maintain it closed. This may be accomplished by placing the pivot, which may be a pin connecting the pivoting jaw to a shank extending from the wrench body in a predetermined region, on the same side of the wrench opening as the pivoting jaw.

The foregoing and other features, objects and advantages of the invention, as well as presently preferred embodiments thereof, will become more apparent from a reading of the following description in connection with the accompanying drawings in which.

Figure 1:
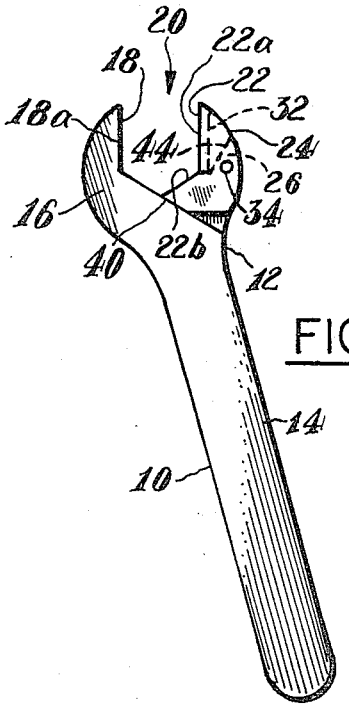
FIG. 1 is a plan view of an open end ratchet wrench embodying the invention.
Figure 2:
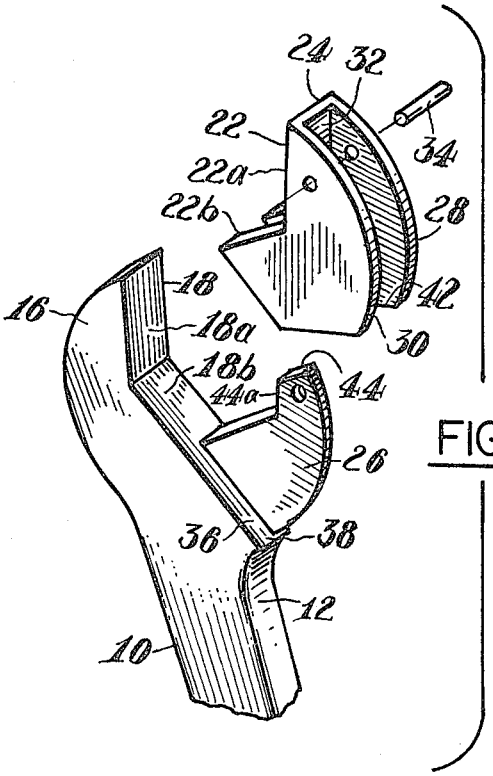
FIG. 2 is an exploded view of the wrench shown in FIG. 1, the entire handle not being shown to simplify the illustration.
Figure 12:
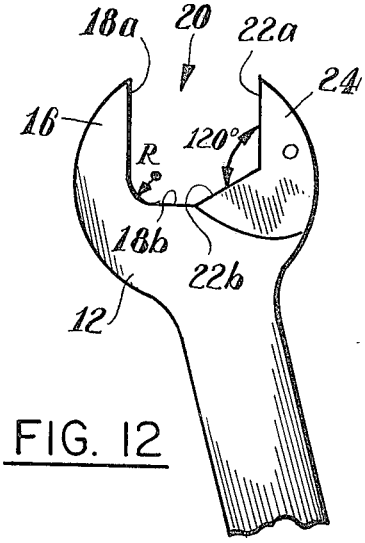
FIG. 12 is a fragmentary plan view of a ratchet wrench in accordance with a still further embodiment of the invention.

Referring first to FIGS. 1 and 2, there is shown an open end wrench having the general configuration of a conventional open end wrench. The wrench has a body 12 which provides a handle 14. Integral with the body 12 is a fixed jaw 16. The fixed jaw has a face 18 which defines one side of the wrench opening 20. The other side of the wrench opening 20 is defined by the face 22 of a pivotal jaw 24. The faces 18 and 22 of the fixed jaw 16 and the pivotal jaw 24 have two sections angularly oriented with respect to each other. These define the upper part of the wrench opening 20 and the base or bottom thereof. The sections 22A and 22B of the pivotal jaw intersect at an obtuse angle which in a preferred embodiment of the invention, which is designed to handle hex nuts and bolt heads, is 120°. The sections 18A and 18B of the fixed jaw also intersect at 120°. These surfaces, 18A and 18B, of the fixed jaw may intersect at other angles less than the obtuse angle between the sections 22A and 22B of the pivotal jaw 24. The sections 18A and 18B of the fixed jaw 16 may intersect at 90° and be separated by a radius as shown in FIG. 12. Such a configuration as is shown in FIG. 12 may be preferred due to manufacturing considerations or where square headed nuts and bolt heads are to be turned so as to provide additional clearance for handling the square headed portion of the nut or bolt during the return or nondriving stroke of the wrench.

The pivotal jaw 24 may also be referred to as a floating jaw in that it may be movably mounted on the wrench body 12 so that it not only rotates but moves axially on the handle 14 or inwardly and outwardly of the wrench opening. For example, the pivotal jaw may be movable within a slot as will be described more fully hereinafter in connection with FIG. 11.

The pivotal jaw 24 is assembled on the wrench body to a shank 26 which is integral with the wrench body and extends therefrom opposite to the fixed jaw 16. The pivotal jaw has side members 28 and 30. A flange 32 is located between the side members 28 and 30. This flange 32 defines part of the upper section 22A. The edges of the side members 28 and 30 define the surfaces of the lower section 22B of the wrench opening defining surface 22. The shank 26 occupies the space between the side members 28 and 30. A pin 34, which extends through holes in the side members 28 and 30 and in the shank 26, defines the pivot of the pivotal jaw 24.

The jaw 24 pivots in opposite directions so as to open and close the wrench opening. The steps 36 and 38 on opposite sides of the shank 26 on the wrench body 12 may engage the lower edges 40 and 42 of the pitoval jaw 24 and limit the rotation thereof in the direction to close the wrench opening 20. The flange 32 is stopped by the forward edge 44 of the shank 26 to limit the rotation of the pivotal jaw in the direction to open the wrench opening 20.

Figure 9:
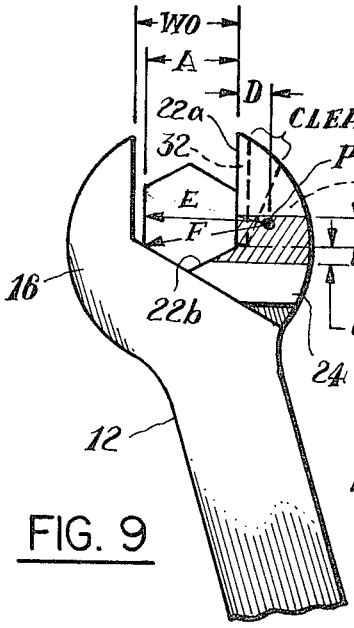
FIG. 9 is a fragmentary plan view of a wrench in accordance with the invention where the torque is transferred to the wrench body through a pivot pin showing how the location of the pivot pin can be designed.

In the embodiment shown in FIG. 1, the edge 44 of the shank 26 is spaced from the flange 32, when the pivotal jaw 24 closes the wrench opening 20. This provides a clearance between the shank 26 and the pivotal jaw 24 which is illustrated in FIG. 9. Then when the wrench is used to turn or torque the item in the wrench opening (e.g., a nut or bolt head), the torque is transferred from the pivotal jaw to the wrench body 12 via the pivot pin 34.

Figure 10:
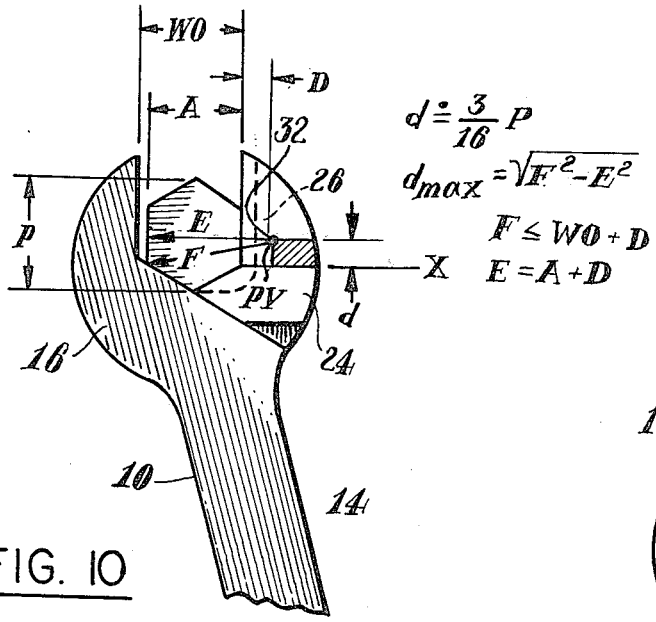
FIG. 10 is a fragmentary plan view of a wrench in accordance with the invention where the torque is transmitted from the pivotal jaw directly to the wrench body, rather than through the pivot pin and showing the design of the location or placement of the pivot.

On the other hand where there is no clearance between the flange 32 and the forward edge 44*a* (See FIG. 2) of the shank 26 when the flange opening is closed, as is illustrated in FIG. 10, the turning torque is transferred from the pivotal jaw 24 directly to the shank 26 and thence to the wrench body. It may be preferable to use a direct transfer to the shank so as to enable the wrench to handle high levels of torque without damage (heavy loading).

The critical factor in the wrench provided by the invention is the placement of the pivot. The pivot point is placed so that the sum of the moments of the forces on the pivoting or floating jaw 24 tends to rotate the jaw to the position where the wrench opening 20 is closed, on the end of the return stroke or, if not in alignment with the item or the forward or turning stroke. By virtue of the pivot location, the sum of the moments of the forces close the wrench opening 20, after the wrench is turned on the return stroke to the maximum opening (ratchets) and immediately upon the commencement of the forward or torquing stroke if the wrench and item are not aligned properly. The pivot location (placement) enables the pivotal jaw to align itself to the item being turned. There is no lost motion in the torquing or forward stroke direction when aligned properly. Another feature of this alignment is that the points of the nut or bolt are in intimate contact with the pivotal jaw; thus avoiding or minimizing rounding of the points. Another distinct feature of the pivot placement is that the cross-section of the fixed jaw does not have to be reduced or weakened and standard wrench opening sizes may be used.

Figure 7A:
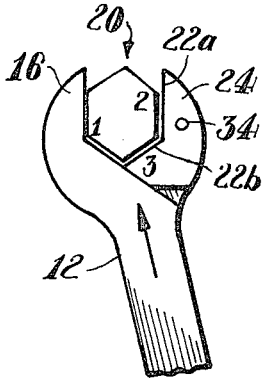
FIGS. 7A, 7B, 7C and 7D are fragmentary plan views of the wrench shown in FIG. 1 in different positions during the return and forward or torquing strokes thereof.
Figure 7B:
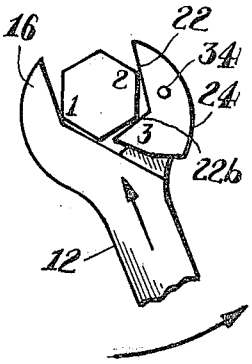

Consider the operation of a wrench in accordance with the invention as shown in FIGS. 7A, 7B, 7C and 7D. In the initial position, as shown in FIG. 7A, the nut is contained within the wrench opening 20 after being driven in a direction (for example, to tighten the nut). It will be appreciated, of course, that a wrench may be used to loosen nuts where desired. Starting on the return or ratcheting stroke the opposite points 1 and 2 of the nut come into contact with the fixed jaw and the upper end of the surface of section 22A of the pivotal jaw 24 above the pivot which in this case is defined by the axis of the pin 34. As the wrench is turned on the return stroke, the pivotal jaw rotates in a clockwise direction while the wrench rotates in a counterclockwise direction about the axis of the nut. Point 3 on the bottom surface of section 22B rises, as point 2 of the nut pushes on the upper portion of the surface of section 22A (see FIG. 7B). This tends to push the wrench off the nut and the wrench turns freely in the ratcheting direction (counterclockwise as shown in FIG. 7).

Figure 7C:
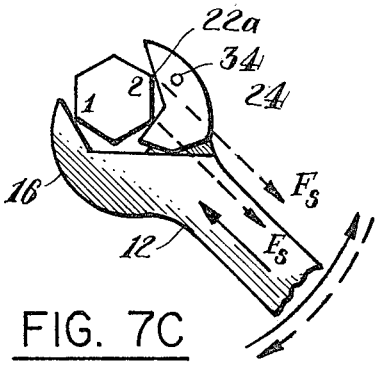
Figure 7D:
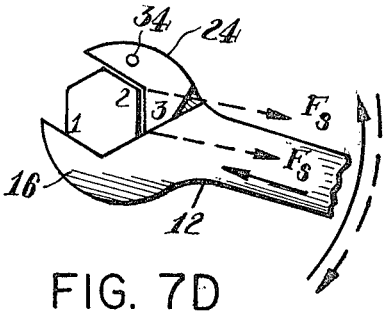

When the wrench turns to the maximum opening which is equal to the distance between the points 1 and 2 of the nut, the return of the pivoting jaw is ready to start. Notice that in the maximum wrench opening position, as shown in FIG. 7C, the resultant forces on the pivotal jaw 24 are all on the inside of the pivot axis of the pin 34. Because of the placement of the pivot, the sum of the moments of the forces is ready to close the jaw with a continued counterclockwise rotation and a slight inward push toward the nut, as is ordinarily applied when an open end wrench is placed upon a nut. As shown in FIG. 7D, the pivotal jaw 24 closes automatically with no lost or added rotational motion immediately at the beginning of the forward or torquing stroke. No spring or cams are necessary to bring the pivoting or floating jaw 24 into the closed position ready for torquing of the nut.

The design of the pivot placement may be also considered from the following view point. When driving the item (torquing direction) the resultant force or moment about the pivot must be in a direction about the pin to rotate the jaw or try to rotate the jaw in a direction opposite the direction of wrench rotation. On return (ratcheting stroke) the resultant forces are above the pivot causing a moment opposite in direction than the wrench rotation until the maximum opening is achieved.

Once the maximum opening is achieved, the resultant force and resultant moment are about the pivot in the same direction as the return stroke causing the jaw to rotate to the closed position.

Figure 8:
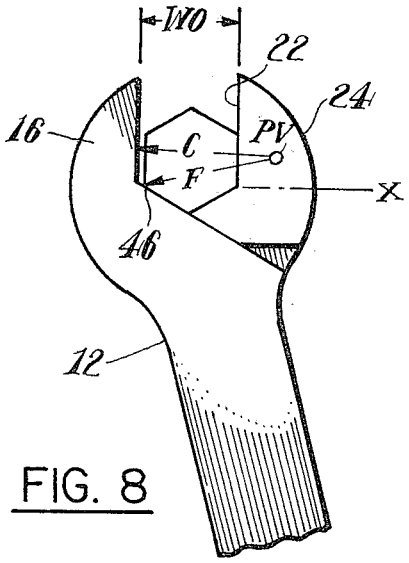
FIG. 8 is a fragmentary plan view of the wrench shown in FIG. 1 illustrating the placement of the pivot for the pivotal jaw thereof.

The design of the pivot placement so as to obtain the wrenching action shown in FIGS. 7A, 7B, 7C and 7D will become more apparent from FIG. 8. It will be seen that the pivot (PV) is on the same side as the wrench opening (WO) as the surface 22 of the pivotal jaw 24 which defines the wrench opening. The distance from the pivot to the lower far corner or point 46 of the nut is less than or equal to the distance from the surface 18 of the fixed jaw to the pivot (the distance along a perpendicular line from the pivot center to the fixed jaw surface 18). The distance to the fixed jaw surface 18 is indicated as C. The distance to the lower far corner 46 of item being turned is indicated as F. The distance F is taken when the nut is biased into intimate contact with the surface 22 of the pivotal jaw 24.

When the shank 26 is designed to provide a clearance for rotation between the flange 32 of the pivotal jaw 24, as shown in FIG. 9, the pivot center PV is in the shaded area shown in FIG. 9. The reference for the height of the shaded area is with respect to a perpendicular line to the surface of section 22A through the apex of the angle formed between the sections 22A and 22B of the pivotal jaw 24. The upper limit or maximum height above this line, which is indicated as being the x axis of the shaded area or $b_{max}$ is approximately 3/16 P where P is the distance between the points of a hex nut. The maximum distance below the x axis is indicated as "a" which is approximately equal to $\frac{1}{8}$ P.

The design of the pivot placement may also be obtained from the wrench opening dimension WO and the wrench size A which is equal to the distance across the flats of the nut (hex or square). The distance D is the length from the surface 22 along the x axis. The design proceeds by choosing a distance D and obtaining the elevation of the pivot center line with respect to the x axis. It will be apparent by examination of FIG. 9 that the maximum elevation $b_{max}$ is equal to the square root of $F^2-E^2$. It will be observed that the distance D can vary from zero, at the apex of the 120° angle between the sections 22A and 22B, to the maximum length of the pivotal jaw 24 along the x axis. The location of the pivot center line is obtained by choosing the distance D and calculating the distance b until the most satisfactory location for placement of the center line is obtained for pivot placement above the x axis. Below the x axis pivot placement is determined by a maximum equal to 0.144 A. Again, this is for a design where shank 26 does not contact surface 32 of floating jaw—pivot pin load transfer. Once a D is chosen and b is calculated, the pivot can fall at a point where D is greater than D which was chosen and b is less than calculated b max—OR a new D chosen and b calculated.

In the case shown in FIG. 10 where the torque transfer is through the shank 26, the pivot center line PV is also in the shaded area. The maximum height above the x axis is approximately 3/16 P. The maximum height calculated utilizing the wrench size A is equal to $\sqrt{F^2-E^2}$. The pivot center line PV may be located anywhere within the shaded area shown in FIG. 10, for any chosen D and calculated b max.

Figure 3:
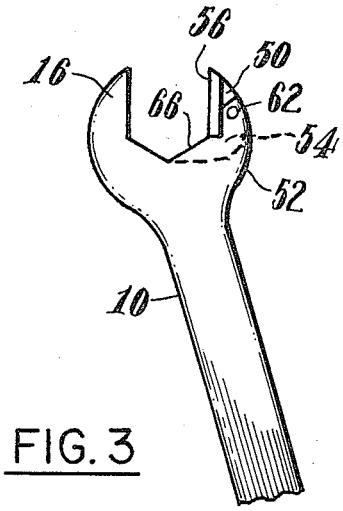
FIG. 3 is a plan view of an open end ratchet wrench in accordance with another embodiment of the invention.
Figure 4:
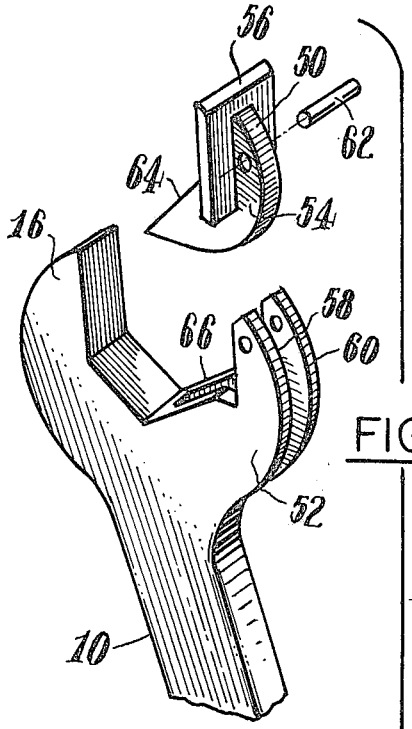
FIG. 4 is an exploded view of the wrench shown in FIG. 3 with the majority of the handle being broken away to simplify the illustration.

Referring next to FIG. 3, there is shown another embodiment of the invention where the pivotal jaw 50 is designed to rotate within the shank 52. The design of the fixed jaw in the embodiment of the invention shown in FIGS. 3 and 4 is the same as in the case of FIGS. 1 and 2 embodiments, and the fixed jaw is indicated by the same reference numeral 16.

The pivotal jaw 50 has a shoe 54 to which is attached a flange 56. The shoe 54 is located in a slot between side members 58 and 60 of a bifurcated shank 52. A pin 62 provides the pivot for the pivotal jaw 50; the placement of the pivot axis (the axis of the pin 60) provides the same wrenching action as described in connection with FIGS. 7A, 7B, 7C and 7D and may be located in accordance with the design criteria described in connection with FIGS. 8, 9 and 10 depending upon whether there is clearance or contact between the flange 50 and the shank side members 58 and 60 so as to provide for torque transfer either through the pin 62 or directly from the flange 56 to the shank side members 58 and 60. The surface 64 of the edge of the shoe 54 defines the bottom of the wrench opening as was described in connection with the section 22B. This surface should desirably be flush with the surfaces 66 of the shank 52 which are adjacent thereto.

Figure 11A:
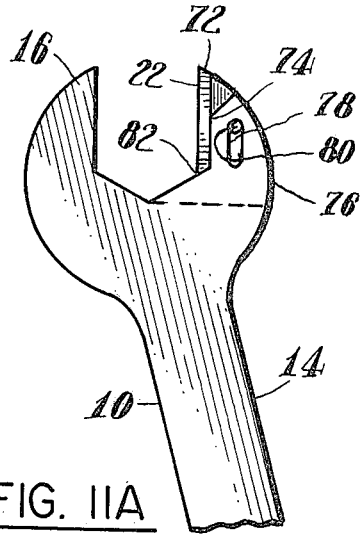
FIGS. 11A and 11B are fragmentary plan views of an open end ratchet wrench in accordance with a still further embodiment of the invention showing the pivotal jaw in the closed and open positions respectively.
Figure 11B:
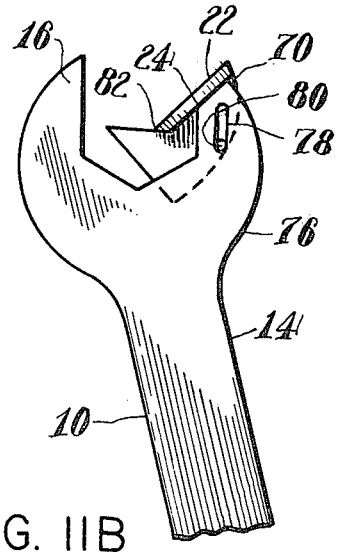

It will be observed that the pivot may be provided not only by the pin but also by a ledge or corner of the shank which is contacted by the outer side of the flange 32 or 56 of the pivotal jaw 24 or 50. Such an arrangement is shown in FIG. 11 where the pivotal jaw 70 is essentially of the same design as the pivotal jaw 50 shown in FIGS. 3 and 4. The fixed jaw 16 is the same design as in embodiment shown in FIGS. 1 and 2 as well as the embodiment shown in FIGS. 3 and 4. The flange 72 bears upon the corner 74 of the side members of the shank 76. The side members of the shank 76 have aligned slots 78 therein. A pin 80 on the pivotal jaw 70 extends into the slot. As the pivotal jaw opens, the pin 80 moves downward and as the pivotal jaw is closed by the nut, the pin 80 moves up to the position shown in FIG. 11A. The pivot is not provided by the pin but rather by the edge or rounded corner 74. The placement of this pivot (i.e., the height d above the x axis through the apex of the angle 82 of 120° on the pivotal jaw 70 is determined utilizing the design criteria shown in FIG. 10).

Figure 5:
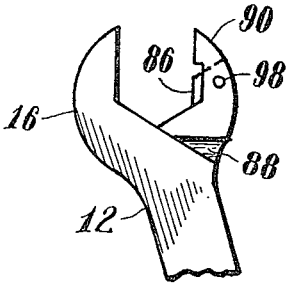
FIG. 5 is a plan view of an open end ratchet wrench in accordance with a still further embodiment of the invention.
Figure 6:
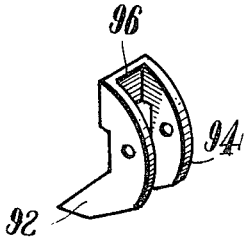
FIG. 6 is a perspective view of the pivotal jaw of the wrench shown in FIG. 5.

Referring to FIGS. 5 and 6, there is shown an embodiment of the invention where all of the loading or torque is directly into the wrench body 12 through an edge 86 of the shank 88; this edge defines part of the upper surface (similar to the surface 22A) provided by the flange 32 in the embodiment of the invention shown in FIGS. 1 and 2. The pivotal jaw 90 has two side members 92 and 94 much like the pivotal jaw 24 shown in FIGS. 1 and 2. A flange 96 between the side members extends only partially down from the open end of the wrench opening such that the edge 86 projects therethrough. The pivotal jaw 90 functions merely to position the item to be turned, such as a nut or bolt head, in the wrench opening in intimate contact with the edge 86. Upon turning, all of the torque or loading is applied directly to the wrench body via the edge 86 and the shank 88. A pin 98 which assembles the pivotal jaw 90 to the shank 88 provides merely for the connection between the pivotal jaw 90 and the remainder of the wrench body.

It will be observed that the wrenches provided in accordance with the herein described embodiments of the invention require only a few parts and may be manufactured and assembled at low cost. The illustrated wrenches have only three parts and can even be made with two parts, for example, if the pin is formed as indentations on the shank or pivoting jaw. Separate wrenches for each size nut or bolt head to be handled may be used. Alternatively, the fixed jaw or the pivotal jaw and shank may be mounted on the wrench body and moved as by a worm gear and rack in a manner similar to the commercially available adjustable or so called "crescent" open end wrenches. Thus, the wrench may be adjusted to fit different sizes of nuts and bolts by opening or closing the wrench opening with the aid of the adjustment mechanism.

From the foregoing description, it will be apparent that there has been provided improved open end ratcheting or one way wrenches. While the embodiments of the invention have been described, variations and modifications thereof, within the scope of the invention will undoubtedly suggest themselves to those skilled in the art. Accordingly, the foregoing description should be taken as illustrative and not in a limiting sense.

We claim:

1. A one-way open-end wrench comprising first and second jaws with opposing faces spaced from each other to define an opening which receives an item having adjacent flats to be turned, said first jaw being rotatable about a pivot with respect to said second jaw in opposite directions to close and maintain closed said opening and engage and drive said item when turned one way and to open said opening and turn freely about said item and then close said opening when turned the opposite way, and means locating said pivot for providing the sum of the moments of the forces on said first jaw about said pivot when said wrench is turned said one way is in the direction to rotate the first jaw to close said opening and maintain said opening closed and when said wrench is turned in the opposite way between adjacent ones of said flats, the sum of the moments of the forces on said first jaw is in the direction to open and then close said opening.

2. The invention as set forth in claim 1 wherein said pivot is located such that the result of all of said forces which provide said moments when said wrench is turned said one way and when turned the opposite way upon reaching the adjacent flat of said item are on the side of said pivot which is located between said pivot and said opening to cause said first jaw to pivot in a direction opposite to said one way.

3. The invention as set forth in claim 1 wherein said face of said first jaw has first and second sections the surfaces of which define an obtuse angle when extended, said pivot being disposed in the vicinity of the apex of said angle above a line intersecting the apex of said angle and perpendicular to the opposing faces of said jaws when said opening is closed such that said item applies forces at least to said second section to close said opening and maintain it closed when said wrench is turned said one way and at least to said first section to open said opening when said wrench is turned the opposite way and close said opening when it reaches maximum size.

4. The invention as set forth in claim 3 wherein said opening has an open end and a closed end, said first section being disposed adjacent to said open end and said second section being disposed between said first section and said closed end and said second section defining part of said closed end.

5. The invention as set forth in claim 4 wherein said wrench has a body, a shank portion of said body being disposed opposite to said second jaw, the face of said second jaw which defines said opening having third and fourth sections respectively extending to said open end of said wrench and defining part of said closed end, said shank being disposed opposite to said third section, and said pivot locating means being provided by said shank and said first jaw.

6. The invention as set forth in claim 5 wherein said first jaw and said shank are spaced from each other to define a clearance therebetween throughout the rotation of said first jaw between the positions thereof where said opening is opened and closed whereby torque is transmitted to said first jaw to said body via said pivot and said shank when said item is turned said one way.

7. The invention as set forth in claim 5 wherein said first jaw and shank are disposed to be in direct contact with each other when said opening is closed whereby torque is transmitted from said first jaw to said body directly via said shank through said contact between said first jaw and said shank.

8. The invention as set forth in claim 5 wherein said pivot comprises a pin which extends axially between said shank and said first jaw.

9. The invention as set forth in claim 8 wherein said pin provides the sole connection between said first jaw and said shank.

10. The invention as set forth in claim 5 wherein said shank has an edge, said first jaw having a section providing one surface opposite to said face thereof which defines said opening, said pivot being provided by said surface and said edge.

11. The invention as set forth in claim 10 further comprising a slot in one of said shank and said first jaw and a pin connected to the other of said shank and first jaw, said pin extending into said slot.

12. The invention as set forth in claim 5 wherein said first jaw comprises first and second sides, a flange between said sides, said flange defining said first section and edges of said sides defining said second section, said shank being disposed between said sides, said pivot being provided by a pin extending through said shank and said sides.

13. The invention as set forth in claim 12 wherein said shank has an edge facing said opening, said edge and said flange having a clearance therebetween whereby torque transfer from said first jaw to said body is via said pin and said shank.

14. The invention as set forth in claim 12 wherein said shank has an edge facing said opening, said edge and said flange being in contact with each other whereby torque transfer from said first jaw to said body is via said contacting edge and flange.

15. The invention as set forth in claim 12 wherein said shank has an edge which defines a portion of said first section disposed between said first and second sections of said first jaw whereby said first jaw guides said item between said first section portion defining shank edge and said third and fourth sections of said second jaw when said first jaw pivots to the position thereof in which said opening is closed.

16. The invention as set forth in claim 5 wherein said shank is provided by a bifurcated portion of said body, said bifurcated portion having two sides, said first jaw having a shoe disposed between said sides, and shoe having an edge with two section which define said obtuse angle, a flange on one of said sections having a face which defines said first section, said second section of said edge defining said section of said first jaw and a pin between said sides extending through said shoe connecting said first jaw and said shank.

17. The invention as set forth in claim 12 wherein said third and fourth sections of said second jaw define an angle therebetween less than said obtuse angle.

18. The invention as set forth in claim 17 wherein said angle is about 90° and said third and fourth sections have a Radius at the junction thereof.

19. The invention as set forth in claim 12 wherein said obtuse angle is 120°.

20. An open-end wrench having a pair of jaws which define a wrench opening between surfaces thereof on opposite sides of said opening which are parallel to each other when said wrench is closed, one of said jaws being rotatable with respect to the other about a pivot on the same side of said opening as said surface thereof which defines said opening, said rotatable jaw surface having first and second sections, said first section extending from the open end of said wrench, and said second section making an obtuse angle with the plane of said first section, said pivot being located in a predetermined region of said rotatable jaw in the direction of the open end of said wrench above a line intersecting the apex of said obtuse angle which line is perpendicular to planes containing said jaw surfaces when said wrench is closed, said region being disposed along said line a distance equal to or greater than the width of said opening from the surface of said other jaw.

21. The wrench according to claim 20 wherein A is the distance between the flats of the largest nut to be turned by said wrench and the maximum dimension of said region along a second line perpendicular to said first named line in a direction towards said open end of said wrench is equal to the square root of $F^2-E^2$, where E is the sum of A and the distance along said first line to said pivot from the jaw surface of said rotatable jaw and F is the distance from said pivot to the point on said nut closest to the side of said opening defined by said other of said pair of jaws and furthest from the open end of said wrench, F being equal to or less than the distance between surfaces of said jaws plus the distance from the jaw surface of said rotatable jaw to the pivot point along said second line.

22. The wrench according to claim 21 wherein the maximum dimension of said region along said second line away from said first line towards the open end of said wrench is approximately equal to 3/16 of the distance between the points of the largest hex nut to be turned by said wrench.

23. The wrench according to claim 22 wherein said obtuse angle is 120°.

24. A one-way open-end wrench comprising first and second jaws with opposing faces spaced from each other to define an opening which receives an item to be turned, said first jaw being rotatable about a pivot with respect to said second jaw in opposite directions to close and maintain closed said opening and engage and drive said item when turned one way and to open said opening and turn freely about said item and then close said opening when turned the opposite way, means locating said pivot for providing the sum of the moments of the forces on said first jaw about said pivot when said wrench is turned said one way in the direction to rotate the first jaw to close said opening and maintain said opening closed, the face of said first jaw having first and second sections the surfaces of which define an obtuse angle when extended, said opening having an open end and a closed end, said first section being disposed adjacent to said open end and said second section being disposed between said first section and said closed end and said second section defining part of said closed end, said wrench having a body, a shank portion of said body being disposed opposite to said second jaw, the face of said second jaw which defines said opening having third and fourth sections respectively extending to said open end of said wrench and defining part of said closed end, said shank being disposed opposite to said third section, said pivot locating means being provided by said shank and said first jaw, and said first jaw and shank being disposed in direct contact with each other when said opening is closed whereby torque is transmitted from said first jaw to said body directly via said shank through said contact between said first jaw and said shank.

25. The invention as set forth in claim 24 wherein said shank has an edge, said first jaw having a section providing one surface opposite to said face thereof which defines said opening, said pivot being provided by said surface and said edge.

26. The invention as set forth in claim 25 further comprising a slot in one of said shank and said first jaw and a pin connected to the other of said shank and said first jaw, said pin extending into said slot.

27. A one-way open-end wrench comprising first and second jaws with opposing faces spaced from each other to define an opening which receives an item to be turned, said first jaw being rotatable about a pivot with respect to said second jaw in opposite directions to close and maintain closed said opening and engage and drive said item when turned one way and to open said opening and turn freely about said item and then close said opening when turned the opposite way, means locating said pivot for providing the sum of the moments of the forces on said first jaw about said pivot when said wrench is turned said one way in the direction to rotate the first jaw to close said opening and maintain said opening closed, the face of said first jaw having first and second sections the surfaces of which define an obtuse angle when extended, said opening having an open end and a closed end, said first section being disposed adjacent to said open end and said second section being disposed between said first section and said closed end and said second section defining part of said closed end, said wrench having a body, a shank portion of said body being disposed opposite to said second jaw, the face of said second jaw which defines said opening having third and fourth sections respectively extending to said open end of said wrench and defining part of said closed end, said shank being disposed opposite to said third section, said pivot locating means being provided by said shank and said first jaw, said first jaw having first and second sides, a flange between said sides, said flange defining said first section and edges of said sides defining said second section, said shank being disposed between said sides, said pivot being provided by a pin extending through said shank and said sides, said shank having an edge extending through said sides and providing a face of said first jaw whereby torque transfer from said body of said wrench to said item is directly through said shank edge.

* * * * *